US005839448A

United States Patent [19]

Woodings

[11] Patent Number: 5,839,448

[45] Date of Patent: Nov. 24, 1998

[54] ABSORBENT ARTICLES

[75] Inventor: Calvin R. Woodings, Nuneaton, United Kingdom

[73] Assignee: Courtaulds Fibres (Holdings) Limited, London, United Kingdom

[21] Appl. No.: 765,477

[22] PCT Filed: Jun. 19, 1995

[86] PCT No.: PCT/GB95/01441

§ 371 Date: Dec. 20, 1996

§ 102(e) Date: Dec. 20, 1996

[87] PCT Pub. No.: WO95/35043

PCT Pub. Date: Dec. 28, 1995

[30] Foreign Application Priority Data

Jun. 20, 1994 [GB] United Kingdom ..... 9412311

[51] Int. Cl.[6] ..... A24B 15/00

[52] U.S. Cl. ..... 131/331; 131/334

[58] Field of Search ..... 131/331, 334, 131/347, 358, 353, 369–375; 425/71; 8/116.4

[56] References Cited

U.S. PATENT DOCUMENTS

| | | | |
|---|---|---|---|
| 3,485,706 | 12/1969 | Evans | 161/169 |
| 4,416,698 | 11/1983 | McCorsley, III | 106/163 R |
| 5,562,739 | 10/1996 | Urben | 8/116.4 |
| 5,582,843 | 12/1996 | Sellars et al. | 425/71 |

FOREIGN PATENT DOCUMENTS

| | | | |
|---|---|---|---|
| WO 95/14398 | 6/1995 | WIPO | 161/169 |

OTHER PUBLICATIONS

"All You Need To Know About Tencel", Stan Davies, Textile Horizons, Feb. 1989.

*Primary Examiner*—Mickey Yu
*Assistant Examiner*—Charles W. Anderson
*Attorney, Agent, or Firm*—Fish & Richardson P.C.

[57] ABSTRACT

Cigarette filters are disclosed which comprise entangled continuous filaments of lyocell. The filaments may be entangled for example by hydroentangling a web which comprises one or more layers of lyocell filaments in spread tow form or by directing radial or circumferential water jets at a tow of lyocell filaments in rod form.

12 Claims, No Drawings

ABSORBENT ARTICLES

This invention relates to absorbent articles, particularly for use as body elements of cigarette filters, and to methods for their manufacture.

Fibre-containing filters for cigarettes are well known. In one known form of construction, the filter body consists of a tow of continuous filaments, commonly cellulose acetate (acetate) filaments, arranged parallel to the long axis of the cigarette. In another known form of construction, the filter body consists of pleated or fluted paper compressed into a cylinder. Such forms of construction contain a single filter element and may be called 'mono' filters. Another known form of construction is the so-called 'dual' filter which contains two filter elements, for example a paper filter towards the interior and a tow filter towards the exterior of the cigarette. A further known form of construction is the so-called 'triple' filter, which resembles a dual filter except that a quantity of activated carbon is interposed between the two filter elements hereinbefore mentioned.

Paper filters are known to be generally more efficient than tow filters at removing tar from tobacco smoke. High tar removal efficiency is particularly desirable in view of the trend towards low-tar cigarettes. Paper filters absorb moisture from the tobacco smoke as the cigarette is smoked, with the result that they become soggy and easy to compress, and offer increased resistance to the passage of smoke through the filter. The external end of a cigarette filter generally becomes stained as the cigarette is smoked. It is known that acetate filters generally exhibit a light tan, uniform staining, whereas paper filters generally exhibit a darker, mottled staining, the latter effect being visually undesirable. Mono paper filters are generally less expensive to manufacture than acetate tow filters even though the manufacturing process is more complex, because paper is a cheaper material than acetate. Dual filters are generally more expensive to manufacture than either mono paper or tow filters because the manufacturing process is more complex, and triple filters more expensive still. It is an object of the present invention to provide a cigarette filter with high tar removal efficiency which overcomes at least some of the disadvantages associated with those conventional paper filters which comprise paper in the filter body.

The present invention provides a cigarette filter characterised in that the body of the filter comprises entangled continuous filaments of lyocell. The present invention further provides a cigarette containing such a filter.

Lyocell filaments and fibres are known materials, and their manufacture is described for example in U.S. Pat. No. 4,246,221. They are readily biodegradable. They are available commercially from Courtaulds plc. They are made by dissolving cellulose in a solvent and extruding the solution so formed through a spinnerette into a coagulating bath which serves to precipitate the cellulose and wash the solvent from the fibre. This process may be called solvent-spinning, and lyocell fibres may also be called solvent-spun cellulose fibres. The cellulose is usually woodpulp. The solvent may be a tertiary amine N-oxide, preferably N-methylmorpholine N-oxide, and in general contains a small proportion of water. If the solvent is a tertiary amine N-oxide, the coagulating bath is preferably an aqueous bath. Fabrics which consist essentially of lyocell filaments and/or fibres may be called lyocell fabrics. The solvent-spinning process is to be distinguished from other known processes for the manufacture of cellulose fibres which rely on the formation and decomposition of a chemical derivative of cellulose, for example the viscose process.

In one embodiment of the invention, the body of the filter of the invention comprises a hydroentangled web which comprises one or more layers of lyocell filaments in the form of spread tow. If desired, the web may in addition comprise one or more layers of parallelised staple fibres, preferably lyocell staple fibres. Hydroentangling is a process for forming a fabric by mechanically wrapping and knotting fibres in a web about each other through the use of high velocity jets or curtains of water. When two or more layers are used, the layers may be arranged so that the fibres lie essentially parallel to each other or preferably so that the fibres in the various layers lie at angles to each other. This latter form of construction provides more uniform physical properties, for example tear strength, in the plane of the fabric in various directions. The web may alternatively comprise one or more layers, preferably one layer, of paper and one or more layers of parallelised continuous filaments of lyocell. The paper may comprise lyocell fibres and/or other types of fibres, for example woodpulp and acetate fibres. Hydroentangled fabrics may also be called spunlace fabrics. Hydroentangled fabrics contain little or no binder. Hydroentangling processes and hydroentangled fabrics are described in U.S. Pat. No. 3,485,706, the contents of which are herein incorporated by way of reference.

The hydroentangled fabric may consist solely of or essentially of lyocell filaments. Alternatively, the fabric may consist of a blend of lyocell filaments with one or more other types of fibre known for use in cigarette filters, for example cellulose acetate filaments or fibres or woodpulp fibres. The web which is submitted to the hydroentangling process may comprise multiple layers and these may be of the same or different composition. For example, in addition to a mono-component layer such as a lyocell filament layer, there can be one or more layers which are of a blend of staple fibres, or mixed filaments and staple fibres or mixed filaments such as lyocell and cellulose acetate filaments.

The basis weight of the hydroentangled fabric may in general be similar to that of the paper used in known paper filters, and may generally be in the range 15 to 150 grams per square meter, preferably 20 to 80 grams per square meter. The number of layers in the web of fibre submitted to the hydroentangling process may be in the range 1 to 10, preferably 1 to 5.

The filaments and any fibres contained in the hydroentangled fabric are preferably fibrillated. Lyocell filaments and fibres may be fibrillated by subjecting them to mechanical abrasion in the wet state, as for example during a hydroentangling process. Fibrillation results in the partial detachment of thin fibres ('fibrils') from the body of the filament or fibre, so that the individual filaments and fibres acquire a 'hairy' appearance. Fibrillated lyocell filaments and fibres have an increased surface area compared with unfibrillated filaments and fibres, and it is thought that this may be advantageous in providing efficient filtration.

The hydroentangled fabric is arranged in the filter body so that the long axis of the cigarette lies parallel to the general plane of the fabric. The fabric is preferably a pleated or fluted fabric. The fabric can be converted into filters on conventional equipment for the manufacture of paper filters. It has been found that hydroentangled fabric can often be processed more rapidly on such equipment than paper, thereby reducing production costs.

The hydroentangled fabric may be used in place of paper to make filters of known forms of construction, for example dual, triple and in particular mono filters.

In another embodiment of the invention, the filter may be prepared by entangling a tow of continuous filaments in rod form, preferably by directing high-pressure water jets radially or circumferentially against the tow. Such a rod is preferably of similar diameter and unit weight to that of known conventional filters. The invention accordingly further provides a process for entangling a lyocell tow, characterised in that it comprises the step of impinging one or more jets of fluid laterally against a lyocell tow of compact cross-section. The tow submitted to the entangling operation consists of substantially parallel continuous filaments. Its cross-section is compact in that when viewed transversely, the ratio of the circumference of the tow to its area is relatively low, preferably in the range from 2:1 to 4:1. The cross-sectional shape of the compact tow is preferably circular, although it may be of other shapes such as oval, square or rectangular. A lyocell tow can be formed into the desired compact shape for example by passage through an orifice of suitable cross-section and dimensions.

The lyocell filaments in the tow submitted to the entangling step are preferably crimped in order to provide good cohesion in the entangled product. Fibrils produced by the entangling process may also serve to provide cohesion in the entangled product. It will be appreciated that the compact tow should not be excessively compressed during the entangling step. Sufficient freedom of movement must be allowed for the filaments to become entangled with each other. If desired, the tow may be overfed into the entangling step.

The fluid is preferably water. The lateral jet or jets are often so disposed that the fluid impinges perpendicularly against the filaments in the tow, but it will be appreciated that exact perpendicularity is not required. It will further be appreciated that impingement of fluid against the tow at an angle other than right angles may be desirable in some cases. For example, an array of jets disposed at a variety of angles may be employed to produce enhanced levels of entanglement. The fluid pressure and flow required to produce the desired degree of entanglement in a given tow can readily be determined by trial and error. The fluid may for example be directed radially against the tow from a plurality of jets, often disposed symmetrically around the tow, or from a circumferential slot jet. If desired, entanglement may be effected stagewise using a series of jets arranged longitudinally along the tow, wherein the nature of the entanglement effected in each stage may be the same or different. The method of the invention may conveniently be performed by conducting the tow past a static jet or jets.

Entangled lyocell tow produced by the method of the invention exhibits good lateral cohesion and stability to deformation. It can be cut to form rods or plugs. It is suitable for the manufacture of filters including cigarette filters, and of other articles as diverse as tampons, ink cartridges for pens, including felt-tipped pens, and wicks for vapourising air-fresheners and the like.

The titre of the lyocell filaments, any lyocell staple fibres and any other types of filaments or fibres incorporated may generally be in the range 0.05 to 20, often 1 to 5 decitex.

A cigarette filter according to the invention may exhibit a high filtration efficiency (high degree of retention of tar and particulates) in comparison with conventional acetate or paper filters. The filter of the invention may advantageously be a mono filter.

What is claimed is:

1. A cigarette filter comprising a filter body which comprises entangled continuous filaments of lyocell.

2. A cigarette filter according to claim 1, characterised in that the body of the filter comprises a hydroentangled web which comprises one or more layers of lyocell filaments in the form of spread tow.

3. The cigarette filter according to claim 1, wherein the filter body comprises an entangled tow of continuous lyocell filaments in rod form.

4. The cigarette filter according to claim 3, wherein the entangled tow is prepared by directing one or more high-pressure water jets radially or circumferentially against a tow of lyocell filaments.

5. A process for entangling a lyocell tow, comprising the step of impinging one or more jets of fluid laterally against a lyocell tow of compact cross-section.

6. The process according to claim 5, wherein the lyocell tow submitted to the entangling step is of circular cross-section.

7. The process according to claim 5, characterised in that the one or more jets of fluid impinge the tow perpendicularly.

8. The process according to claim 5, wherein the fluid is water.

9. A cigarette comprising a filter having a body, wherein the body of the filter comprises entangled continuous filaments of lyocell.

10. A cigarette according to claim 9 wherein the body of the filter comprises a hydroentangled web which comprises one or more layers of lyocell filaments in the form of spread tow.

11. A cigarette according to claim 9 wherein the body of the filter comprises an entangled tow of continuous lyocell filaments in rod form.

12. A cigarette according to claim 11 wherein the entangled tow is prepared by directing one or more high-pressure water jets radially or circumferentially against a tow of lyocell filaments.

* * * * *